US010684575B2

(12) United States Patent
Hashimoto

(10) Patent No.: US 10,684,575 B2
(45) Date of Patent: Jun. 16, 2020

(54) TONER STIRRING DEVICE AND IMAGE FORMING APPARATUS

(71) Applicant: KONICA MINOLTA, INC., Chiyoda-ku, Tokyo (JP)

(72) Inventor: Yusuke Hashimoto, Anjo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/424,576

(22) Filed: May 29, 2019

(65) Prior Publication Data

US 2020/0012212 A1 Jan. 9, 2020

(30) Foreign Application Priority Data

Jul. 9, 2018 (JP) ..... 2018-130043

(51) Int. Cl.
*G03G 15/08* (2006.01)

(52) U.S. Cl.
CPC ..... *G03G 15/0889* (2013.01); *G03G 15/0822* (2013.01); *G03G 15/0887* (2013.01); *G03G 15/0891* (2013.01)

(58) Field of Classification Search
CPC ..... G03G 15/0887; G03G 15/0889; G03G 15/0891; G03G 15/0822; G03G 2215/085
See application file for complete search history.

(56) References Cited

U.S. PATENT DOCUMENTS 10,474,066 B1 * 11/2019 Tatsumi ..... G03G 15/0889

FOREIGN PATENT DOCUMENTS

JP 2014119704 A 6/2014

* cited by examiner

*Primary Examiner* — David M. Gray
*Assistant Examiner* — Andrew V Do
(74) *Attorney, Agent, or Firm* — Buchanan Ingersoll & Rooney PC

(57) ABSTRACT

A toner stirring device includes: a toner storage that stores toner; a stirring member that is rotated around a rotation axis to stir the toner inside the toner storage and extends to a radially outer peripheral side; and an elastic sheet that has one end fixed to a front side part in a rotation direction of the stirring member and extends to an outer peripheral side along the stirring member, wherein the elastic sheet includes a through hole at a position corresponding to a tip part of the stirring member, and the tip part of the stirring member passes through the through hole when the elastic sheet is rotated together with the stirring member in a state in which an outer peripheral side part of the elastic sheet contacts, on a more rear side in the rotation direction than the stirring member, an inner wall of the toner storage.

4 Claims, 11 Drawing Sheets

TONER STIRRING DEVICE AND IMAGE FORMING APPARATUS

The entire disclosure of Japanese patent Application No. 2018-130043, filed on Jul. 9, 2018, is incorporated herein by reference in its entirety.

BACKGROUND

Technological Field

The present invention relates to a toner stirring device used in an image forming apparatus or the like and a technology associated therewith.

Description of the Related Art

An image forming apparatus is provided with a toner supply device that supplies toner (powder toner) of each of color components including yellow of (Y), magenta (M), cyan (C), and black (K) to a developing device of each of the color components.

There is a technology of stirring toner inside a toner storage in the toner supply device (see JP 2014-119704 A). Note that the toner supply device is also referred to as a toner stirring device or the like.

Specifically, in JP 2014-119704 A, a stirring member (air stirring paddle) that is rotated around a rotation axis to stir the toner inside the toner storage is provided in a manner extending toward a radially outer peripheral side, and additionally, an elastic sheet (mylar sheet) is provided at the stirring member in a manner extending along the stirring member toward the outer peripheral side from a root part of the stirring member. Additionally, the toner inside the toner storage is stirred by rotating the stirring member and the elastic sheet around a rotation axis. According to this technology, toner aggregation inside the toner storage is suppressed.

Here, in a toner stifling device, there is a problem that toner adheres to an inner wall of a toner storage.

Considering this point, it is possible to conceive a technology in which an elastic sheet is provided at a front side part in a rotation direction of a stirring member, and an elastic sheet is rotated while being made to contact the inner wall of the toner storage. With this technology, toner adhering (sticking) to the inner wall of the toner storage can be scraped off by utilizing elastic force (force directed to the front side in the rotation direction) acting on an outer peripheral side part of the elastic sheet.

However, in this technology, when the elastic sheet is rotated together with the stirring member, a stirring member is located on a rear side in the rotation direction of the elastic sheet, and therefore, the elastic sheet cannot be deformed in a range corresponding to a region from a root part of the stirring member to a tip of the stirring member, and the elastic sheet is deformed in a space from the tip of the stirring member to the inner wall of the toner storage. In a case where the space is relatively narrow, the elastic sheet is deformed with a small radius of curvature. In other words, a bending degree of the elastic sheet is increased when the elastic sheet is rotated.

In a case where the elastic sheet is deformed with a small radius of curvature when the elastic sheet is rotated, the elastic sheet is more likely to be plastically deformed. When the elastic sheet is plastically deformed, the elastic force (force directed to the front side in the rotation direction) in the outer peripheral side part of the elastic sheet is weakened, and the toner adhering to the inner wall of the toner storage is not sufficiently scraped off.

SUMMARY

Accordingly, the present invention is directed to providing a toner stirring device and a technology associated therewith, in which the bending degree of the elastic sheet can be reduced when the elastic sheet is rotated.

To achieve the abovementioned object, according to an aspect of the present invention, a toner stirring device reflecting one aspect of the present invention comprises: a toner storage that stores toner; a stirring member that is rotated around a rotation axis to stir the toner inside the toner storage and extends to a radially outer peripheral side; and an elastic sheet that has one end fixed to a front side part in a rotation direction of the stirring member and extends to an outer peripheral side along the stirring member, wherein the elastic sheet includes a through hole at a position corresponding to a tip part of the stirring member, and the tip part of the stirring member passes through the through hole when the elastic sheet is rotated together with the stirring member in a state in which an outer peripheral side part of the elastic sheet contacts, on a more rear side in the rotation direction than the stirring member, an inner wall of the toner storage.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

1. Outline of Device

Figure 1:
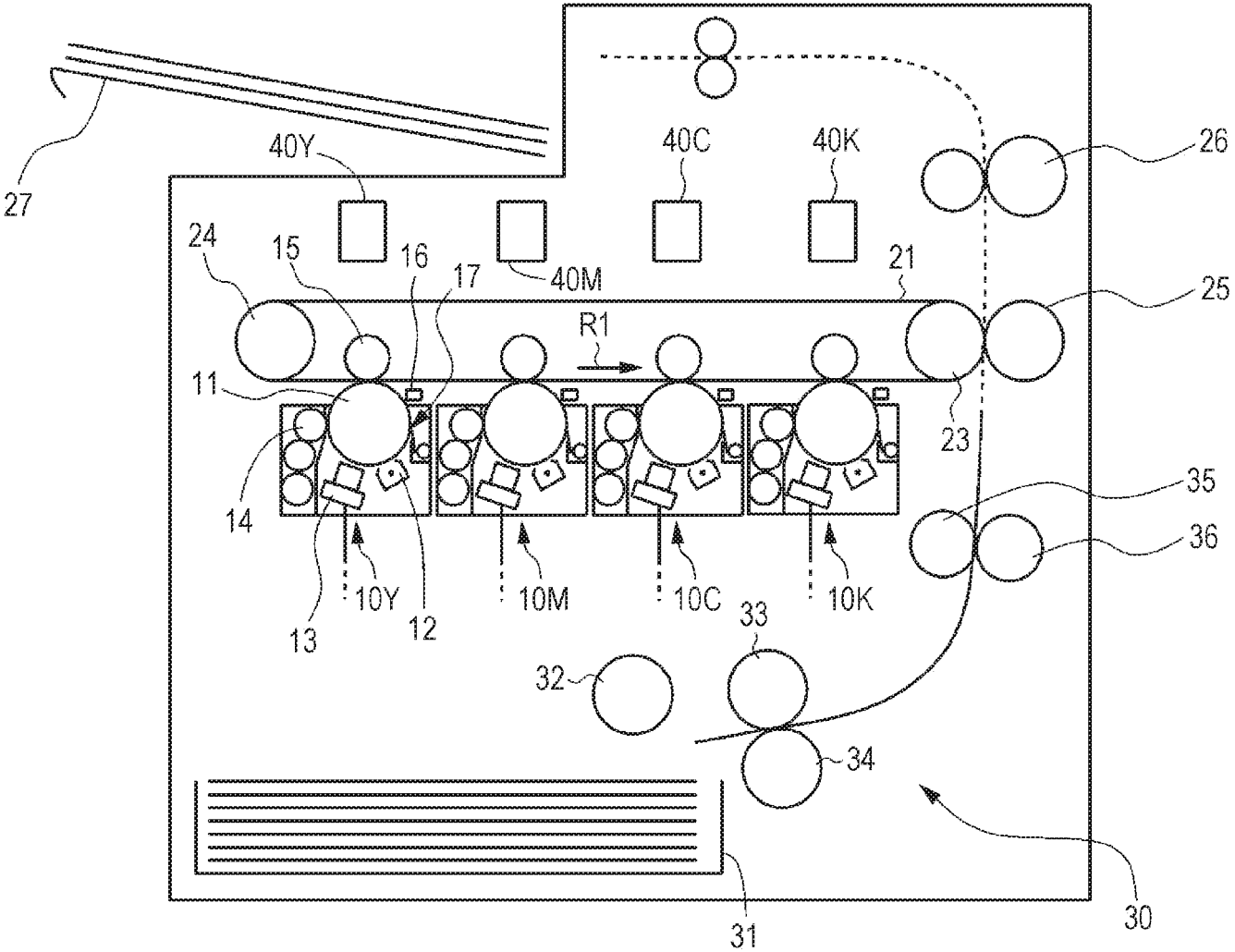
FIG. 1 is a diagram illustrating a schematic structure of an image forming apparatus according to an embodiment.

FIG. 1 is a diagram illustrating a schematic structure of an image forming apparatus 1 according to the present embodiment. The image forming apparatus 1 is an apparatus that develops an electrostatic latent image on an image carrier to form an image. Here, as the image forming apparatus, an electrophotographic apparatus, more specifically, a full-color electrophotographic apparatus of a tandem system is exemplified.

As illustrated in FIG. 1, the image forming apparatus 1 includes a plurality (more specifically, four) of imaging units 10 (specifically, 10Y, 10M, 10C, and 10K). Specifically, the image forming apparatus 1 includes an imaging unit 10Y for yellow, an imaging unit 10M for magenta, an imaging unit 10C for cyan, and an imaging unit 10K for black. Each of the imaging units 10 electro-photographically forms an image of each of the color components (specifically, the respective components including yellow (Y), magenta (M), cyan (C), and black (K)) out of a finally-output image, and transfers the image onto an intermediate transfer belt (also referred to as an intermediate transfer body) 21. Then, the images of the respective color components superimposed on the intermediate transfer belt 21 are further transferred onto paper (transfer material), thereby forming a full-color image on the paper. Note that the intermediate transfer belt 21 is also expressed as an image carrier that temporarily carries the toner images transferred from respective photoreceptors.

The four imaging units 10 (10Y, 10M, 10C, and 10K) are arranged in series mainly at a lower part of a lower-side linear part of the intermediate transfer belt 21 along the lower-side linear part, and the intermediate transfer belt 21 is wound around a driving roller 23 and a winding roller 24. Each of the imaging units 10 includes a photoreceptor 11, an electric charger 12, an exposure device 13, a developing device 14, a first transfer device (primary transfer device) 15, an eraser 16, and a cleaner 17. More specifically, in each of the imaging units 10, the electric charger 12, the exposure device 13, the developing device 14, the first transfer device 15, the eraser 16, and the cleaner 17 are sequentially arranged in a clockwise direction in a manner surrounding an outer periphery of the photoreceptor 11 having a substantially columnar shape. Among these components, the first transfer device 15 (more specifically, a transfer roller) is arranged at a position facing the photoreceptor 11 while interposing the intermediate transfer belt 21.

The intermediate transfer belt 21 is moved in a direction of an arrow R1 (FIG. 1) by drive of the driving roller 23. Additionally, a transfer roller (secondary transfer roller) 25 is provided at a position facing the driving roller 23 while interposing the intermediate transfer belt 21.

A paper feeder 30 is provided on a lower side of each of the imaging units 10 (upstream side on a conveyance path). The paper feeder 30 includes a paper feed tray 31, a feed roller 32, a paper feed roller 33, a separation roller 34, and registration rollers 35 and 36.

On an upper side of each of the imaging units 10, a toner supply device 40 (more specifically, 40Y, 40M, 40C, or 40K) to supply toner (powder toner) to the developing device 14 inside each of the imaging units 10 is provided. The toner supply device 40 will be described in details later.

A fixing device 26 is provided on a downstream side in a conveyance direction of paper having passed the position of the transfer roller (secondary transfer roller) 25, and a paper ejector 27 is provided on a further downstream side in the conveyance direction.

The image forming apparatus 1 functions as a color page printer by printing out an image by a print mechanism as described above, and the image is based on image data transmitted from another information processor (such as personal computer) connected via a network or the like.

2. Toner Supply Device 40

Figure 2:
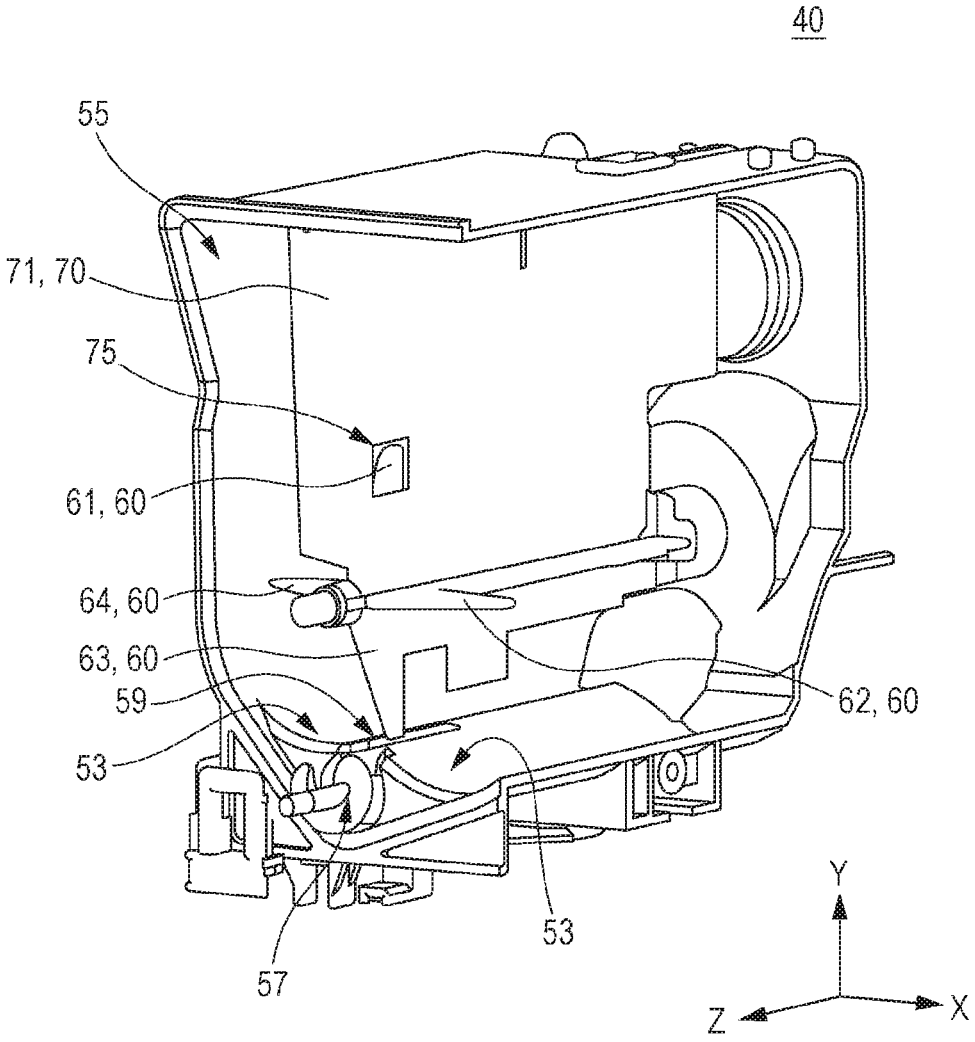
FIG. 2 is a view illustrating a basic structure of a toner supply device (toner stirring device)

FIG. 2 is a view illustrating a basic structure of the toner supply device 40. Here, the toner supply devices 40 (40Y, 40M, 40C, and 40K) of the respective color components of Y, M, C, and K are provided. Since each of the toner supply devices 40 is a device that stirs the toner inside the toner supply device 40 by using a stirring paddle member 60 (described later), the toner supply device is also referred to as a toner stirring device or the like.

The toner supply device 40 has a toner storage 55 that stores the toner. Here, an inner height of the toner storage 55 (length in a vertical direction (Y direction (FIG. 2)) is larger than an inner width of the toner storage 55 (length in a horizontal direction (X direction (FIG. 2)). In other words, a cross-sectional shape (cross-sectional shape in a direction perpendicular to a depth direction (Z direction (FIG. 2)) of the toner storage 55 is a vertically long shape (more specifically, a substantially rectangular shape). However, not limited thereto, the cross-sectional shape of the toner storage 55 may also be, for example, a laterally long shape, a substantially square shape, a circular shape, or the like.

Additionally, a lower part of the toner storage 55 inside the toner supply device 40 is provided with a toner conveyor 57 partitioned by a partition 53. The partition 53 is provided with a toner supply port 59 through which the toner inside the toner storage 55 is supplied to the toner conveyor 57. The toner inside the toner storage 55 is supplied to the toner conveyor 57 via the toner supply port 59 and then conveyed to the developing device 14 by the toner conveyor 57. Consequently, the toner is supplied to the developing device 14.

Figure 3:
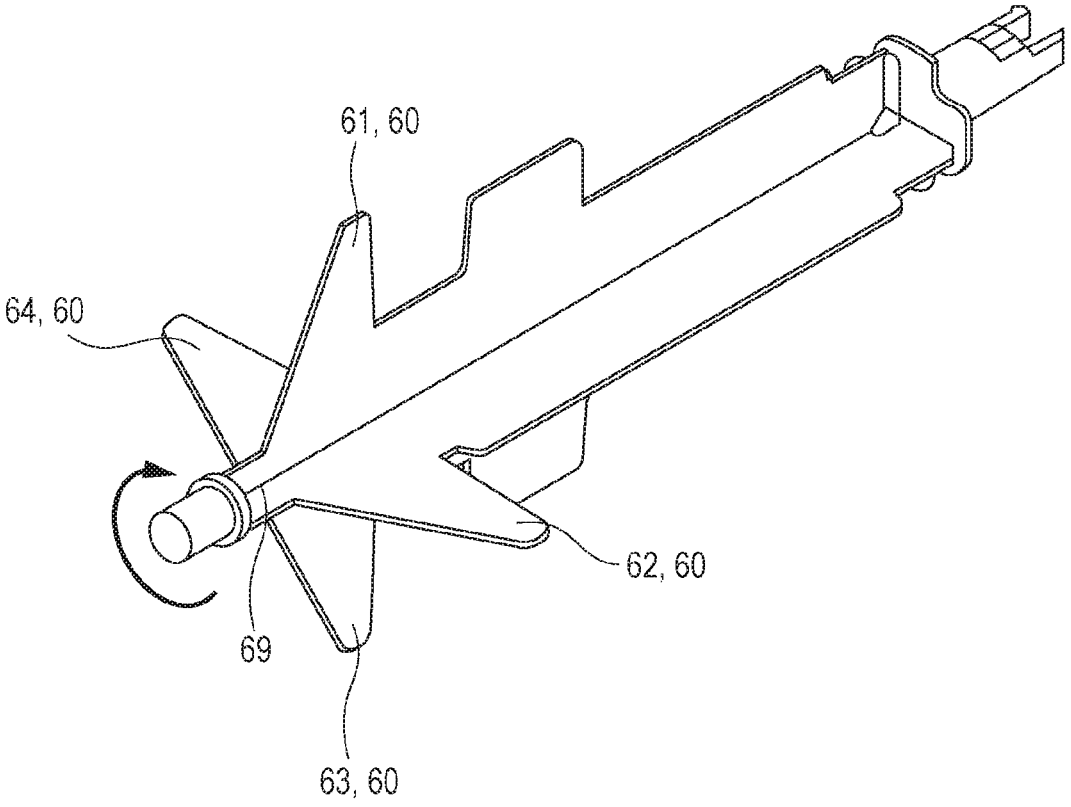
FIG. 3 is a perspective view of a stirring paddle member (stirring member)

Inside the toner storage 55, a plurality of stirring paddle members 60 is provided. Each of the stirring paddle members 60 is a stirring member that is rotated around a rotation axis to stir the toner inside the toner storage 55. Here, four stirring paddle members 61 to 64 are provided. (see also FIG. 3). FIG. 3 is a perspective view of the stirring paddle members 60 (61 to 64). Note that the number of stirring paddle members 60 is not limited to four and may also be three or less (one or more and three or less) or may be five or more.

Each of the plurality of stirring paddle members 60 (61 to 64) is provided at a shaft member 69 in a manner extending (projecting) to a radially outer peripheral side from a center side of the rotation axis (more specifically, in a direction perpendicular to the rotation axis) (see FIG. 3). Then, each of the plurality of stirring paddle members 60 (61 to 64) is rotated around the rotation axis along with rotation operation of the shaft member 69. Consequently, the toner inside the toner storage 55 is stirred, and aggregation of the toner is suppressed.

Additionally, the respective stirring paddle members 61 to 64 are arranged in a manner shifted from each other by a predetermined angle (here, 90 degrees) in the rotation direction around the rotation axis (see FIG. 3). More specifically, the stirring paddle member 62 is arranged in a manner shifted from the stifling paddle member 61 by 90 degrees in the rotation direction. Also, the stirring paddle member 63 is arranged in a manner shifted from the stirring paddle member 62 by 90 degrees (in other words, shifted from the stirring paddle member 61 by 180 degrees) in the rotation direction. Furthermore, the stirring paddle member 64 is arranged in a manner shifted from the stirring paddle member 63 by 90 degrees (in other words, shifted from the stirring paddle member 61 by 270 degrees) in the rotation direction. Note that the four stirring paddle members 61 to 64 here are arranged at the same position in an axial direction of the rotation axis.

Here, a blade-shaped (plate-shaped) member (blade member) is exemplified as each of the stirring paddle members 60 (61 to 64). However, not limited thereto, each of the stirring paddle members 60 may also be a rod-shaped member, for example.

Figure 6:
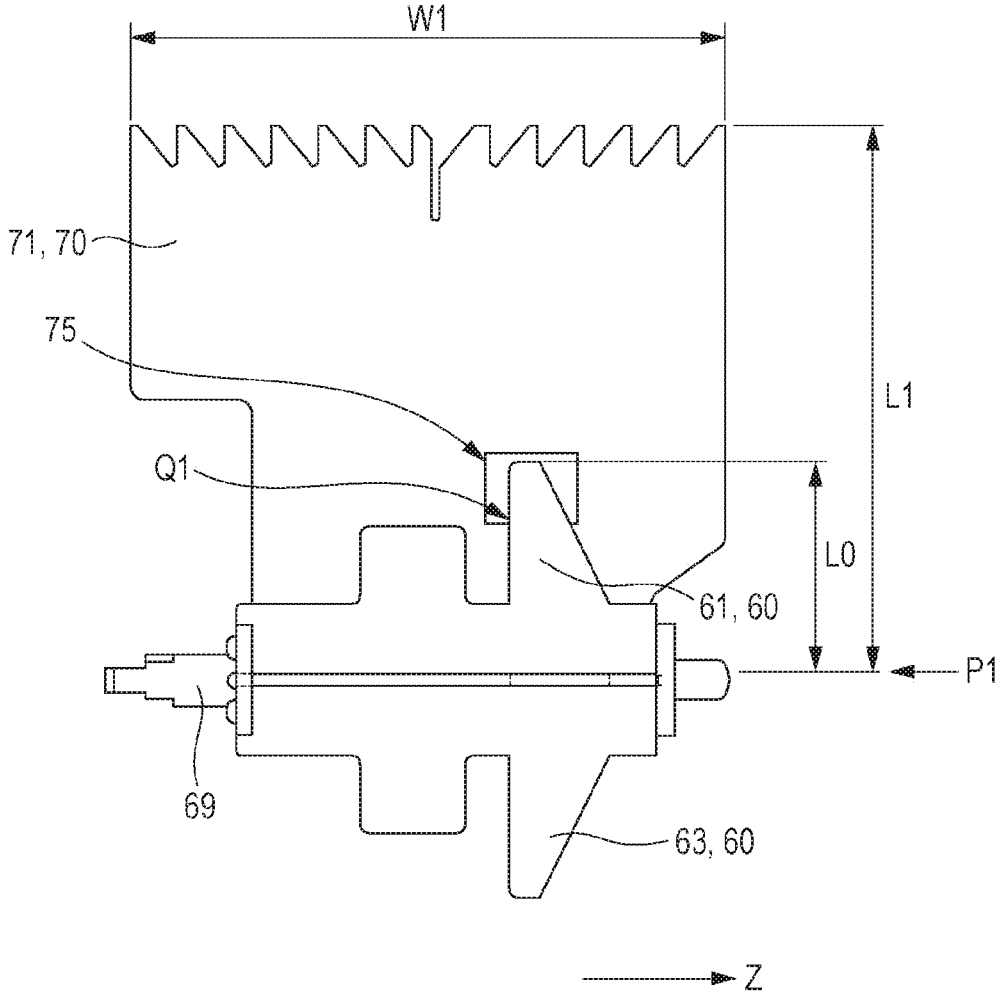
FIG. 6 is a side view of the stirring paddle member and the elastic sheet in the state of FIG. 5 when viewed from an −X side.

In the toner supply device 40, an elastic sheet 70 (71) is provided at a stirring paddle member 60 as illustrated in FIGS. 2, 6, and the like.

Figure 4:
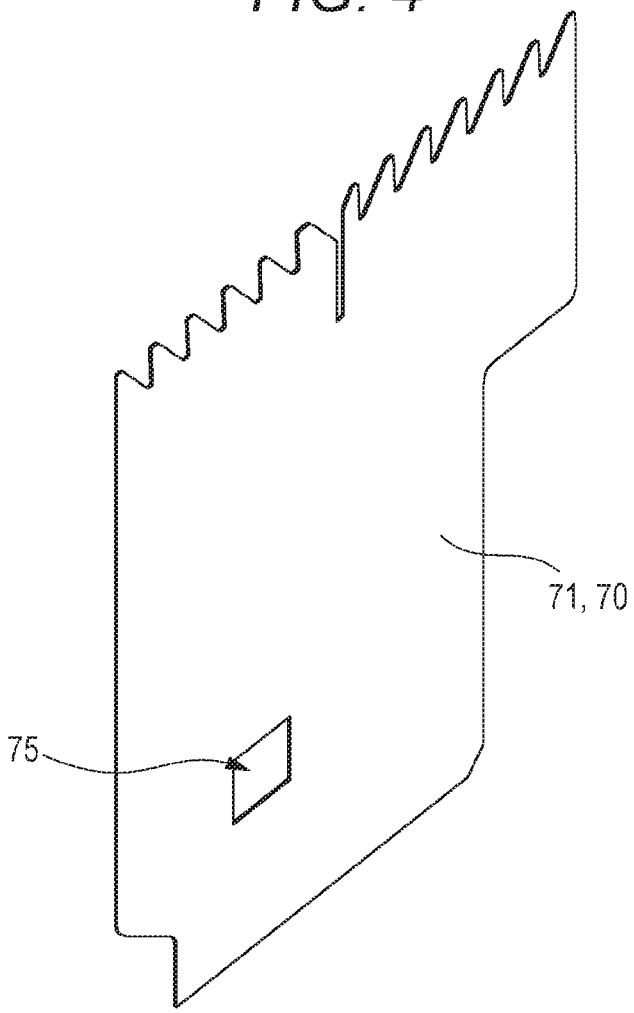
FIG. 4 is a perspective view of an elastic sheet.

The elastic sheet 70 is a flexible sheet member (such as a resin film) (see also FIG. 4). FIG. 4 is a perspective view of the elastic sheet 70.

Here, the elastic sheet 70 (71) is provided at the stirring paddle member 61 that is one of the plurality of stirring paddle members 61 to 64.

Figure 5:
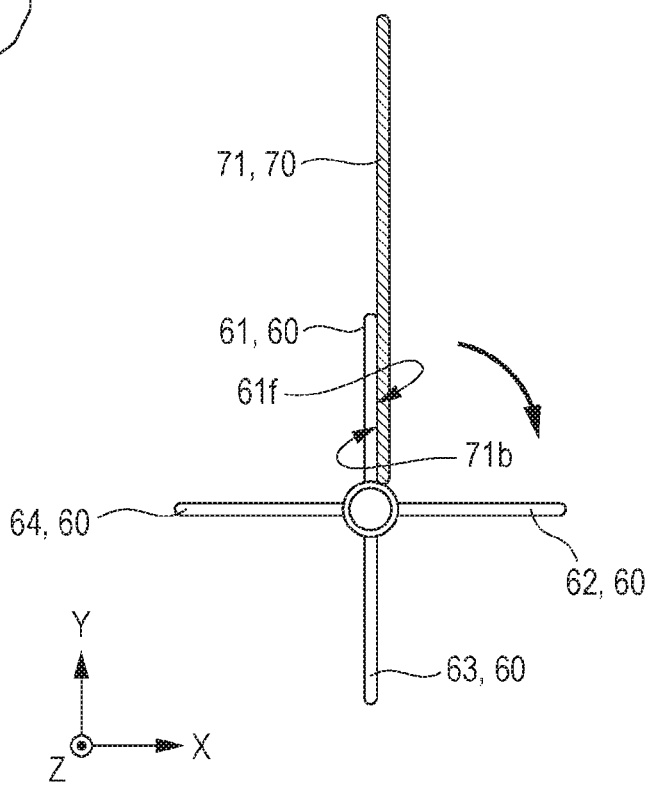
FIG. 5 is a front view of the stirring paddle member and the elastic sheet in a state of being oriented upward (+Y side)

Specifically, the elastic sheet 71 (one end (inner peripheral side part) of the elastic sheet 71) is fixed to a front side part 61*f* in the rotation direction of the stirring paddle member 61 (part located on a more front side than the stirring paddle member 61 in the rotation direction of the stirring paddle member 61) (see FIG. 5). FIG. 5 is a front view of the stirring paddle member 61 and the elastic sheet 71 in a state in which a tip part of the stirring paddle member 61 is oriented upward (+Y side). In the state of FIG. 5, the elastic sheet 71 is fixed to a right side part (front side pail 61*f* in the rotation direction) of the stirring paddle member 61. Additionally, here, the elastic sheet 71 (surface 71*b* on a rear side in the rotation direction of the elastic sheet 71) is bonded to a surface on the front side in the rotation direction of the blade-shaped (plate-shaped) stirring paddle member 61 (see FIG. 5) with a bonding agent. Note that an outer peripheral side part of the elastic sheet 71 is not fixed (bonded) to any part.

Additionally, the elastic sheet 71 (70) is arranged at the stirring paddle member 61 (60) in a manner extending from the center side of the rotation axis toward the radially outer peripheral side (more specifically, in the direction perpendicular to the rotation axis) (see FIG. 5). Specifically, the elastic sheet 71 extends along the stirring paddle member 61 from a root part (reference position P1) of the stirring paddle member 61 toward the outer peripheral side (more specifically, in the extending direction of to stirring paddle member 61). Additionally, the elastic sheet 71 is rotated around the rotation axis together with the stirring paddle member 61.

The elastic sheet 71 has, in a cross section perpendicular to the axial direction of the rotation axis, a length (entire length) L1 (FIG. 6) equal to or longer than a length that enables contact with an inner wall closest from the rotation axis (such as a lower-side inner wall) out of inner walls on four sides including upper, lower, left, and right sides (upper-side inner wall, lower-side inner wall, left-side inner wall, and right-side inner wall) of the toner storage 55 having the substantially rectangular cross-sectional shape.

Additionally, the elastic sheet 71 preferably has, in the cross section perpendicular to the axial direction of the rotation axis, the length L1 equal to or longer than a length that enables contact with an inner wall secondarily close to the rotation axis next to the lower-side inner wall (such as the left-side and/or right-side inner wall) out of the inner walls on the four sides of the toner storage 55.

Here, the elastic sheet 71 has, in the cross section perpendicular to the axial direction of the rotation axis, the length L1 (L1=K1) substantially equal to a length K1 (FIG. 7) that enables contact with the inner wall located most distant from the rotation axis (such as the upper-side inner wall) out of the inner walls on the four sides of the toner storage 55.

Thus, the elastic sheet 71 has, in the cross section perpendicular to the axial direction of the rotation axis, a length that enables an outer peripheral side end part (edge part on the outer peripheral side) of the elastic sheet 71 to contact a part of the inner walls of the toner storage 55.

Note that a width W1 (FIG. 6) of the outer peripheral side end part of the elastic sheet 71 (70) is substantially the same as a depth inside the toner storage 55 (a length in the Z direction (FIG. 2)).

Meanwhile, the elastic sheet 71 is provided with a through hole (opening) 75 at a position corresponding to the tip part of the stirring paddle member 61 (60) (see FIG. 6). FIG. 6 is a side view of the stirring paddle member 61 and the elastic sheet 71 in the state of FIG. 5 when viewed from the −X side. The elastic sheet 71 is provided with the through hole 75 at the position corresponding to the tip part of the stirring paddle member 61 both in the Z direction and in the extending direction of the stirring paddle member 61.

An outer peripheral side end part of the through hole 75 is located close to the tip of the stirring paddle member 61. Additionally, an inner peripheral side end part Q1 (FIG. 6) of the through hole 75 is located on a more inner peripheral side (rotation axis side) than the tip of the stirring paddle member 61. Here, the inner peripheral side end part Q1 of the through hole 75 exists at a position on the inner peripheral side apart about one third a length L0 of the stirring paddle member 61 from the lip of the stirring paddle member 61 (FIG. 6). Note that, not limited thereto, the inner peripheral side end part Q1 of the through hole 75 may also be located at a position on the inner peripheral side apart from the tip of the stirring paddle member 61 by about a half the length L0 of the stirring paddle member 61, for example.

Here, a length of the through hole 75 in the extending direction of the elastic sheet 71 is about one third the length L0 of the stirring paddle member 61 in the extending direction of the stirring paddle member 61. A width (length in the Z direction) of the through hole 75 is larger than a width of the tip part of the stirring paddle member 61 (the maximum width of the stirring of paddle member 61 in a range from the tip of the stirring paddle member 61 to the position located at about one third the length L0 of the stirring paddle member 61 on the inner peripheral side).

Additionally, as describer later, the tip part of the stirring paddle member 61 passes through the through hole 75 when the elastic sheet 71 is rotated in a state in which the outer peripheral side part of the elastic sheet 71 contacts, on the more rear side in the rotation direction than the stirring paddle member 61, the inner wall of the toner storage 55 (see FIG. 8).

The above-described operation will be described below by using FIGS. 7 and 8 and the like.

Figure 7:
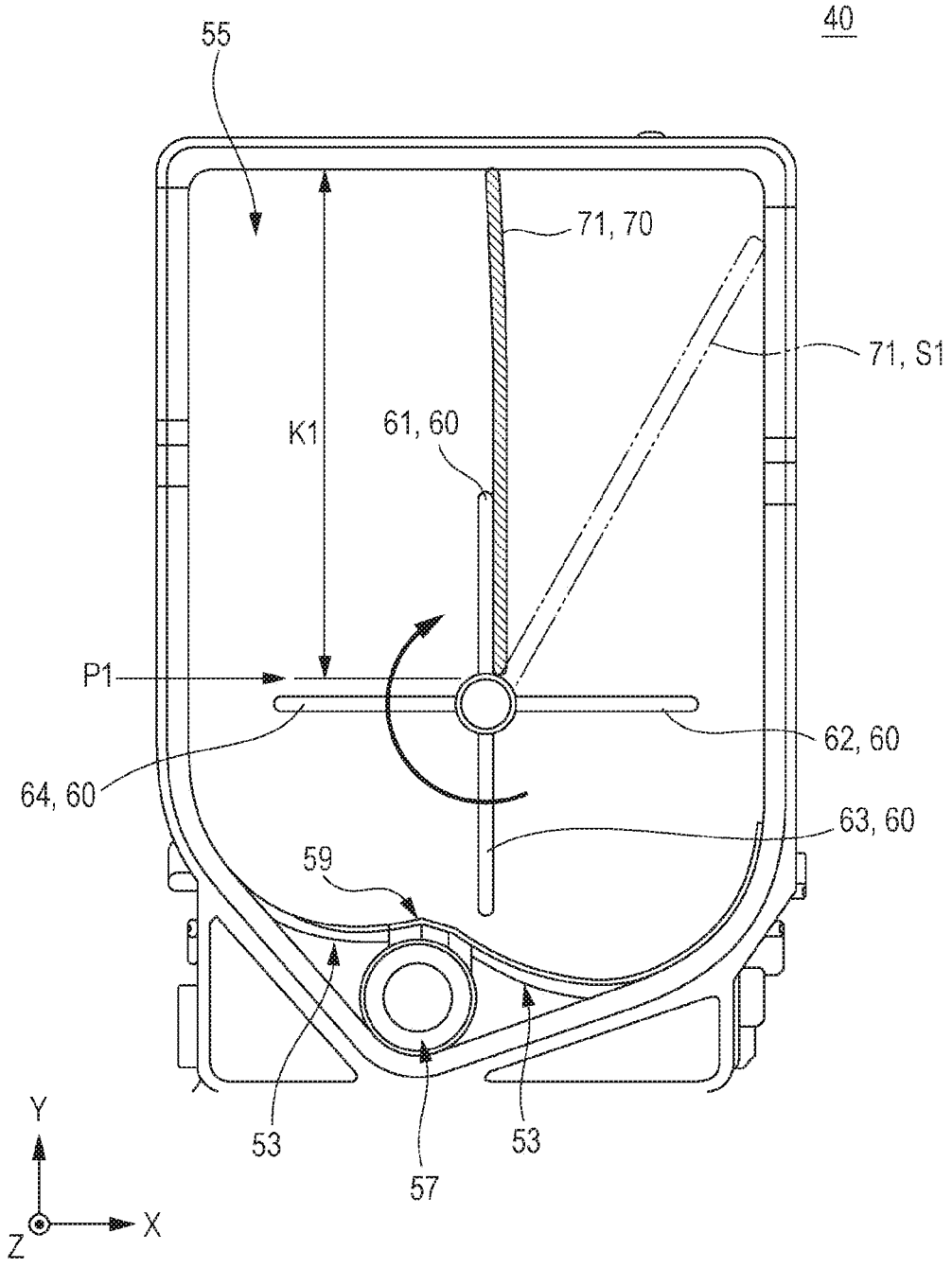
FIG. 7 is a view illustrating a state in which a tip part of the stirring paddle member is oriented upward (+Y side)

FIG. 7 is a view illustrating a state in which the stirring paddle member 61 (more specifically, the tip part of the stirring paddle member 61) is oriented upward (+Y side). Here, the entire length LA of the elastic sheet 71 is substantially the same as the length K1 (FIG. 7) from the root part of the stirring paddle member 61 (more specifically, from the reference position P1 of the stirring paddle member 61) to the upper-side inner wall of the toner storage 55 (L1=K1). Due to this, the outer peripheral side part of the elastic sheet 71 is hardly deformed even in a case where the outer peripheral side end part of the elastic sheet 71 contacts the upper-side inner wall of the toner storage 55.

After that, the elastic sheet 71 is also rotated along with rotation of the stirring paddle member 61, and the outer peripheral side end part of the elastic sheet 71 is moved from the upper-side inner wall (+Y side) to the right-side inner wall (+X side) of the toner storage 55 (right-side part out of the inner walls of the toner storage 55) and contacts the right-side inner wall (see a state S1 in FIG. 7).

Then, when the elastic sheet 71 is further rotated in a state in which the outer peripheral side part of the elastic sheet 71 contacts the right-side inner wall of the toner storage 55, frictional force acts on the outer peripheral side part of the elastic sheet 71 (particularly near the outer peripheral side end part) from the inner wall, and the flexible elastic sheet 71 is gradually deformed by receiving the frictional force. Specifically, an inner peripheral side part of the elastic sheet 71 is rotated together with the stirring paddle member 61, whereas the outer peripheral side part of the elastic sheet 71 is rotated at an angular velocity slower than an angular velocity of the inner peripheral side part (the stirring paddle member 61) of the elastic sheet 71, thereby gradually deforming (bending) the elastic sheet 71. Stated differently, when the outer peripheral side part of the elastic sheet 71 (specifically, the part located on the more outer peripheral side than an end part on the rotation axis side (inner peripheral side end part) Q1 of the through hole 75 (see FIGS. 6 and 8)) is relatively moved to the more rear side in the rotation direction than the stirring paddle member 61 (relative to the stirring paddle member 61), the elastic sheet 71 is gradually deformed.

At this point, the elastic sheet 71 is gradually bent while making the tip part of the stirring paddle member 61 pass the through hole 75 (while letting out the tip part of the stirring paddle member 61 through the through hole 75). Therefore, the tip part of the stirring paddle member 61 does not contact the elastic sheet 71.

Figure 8:
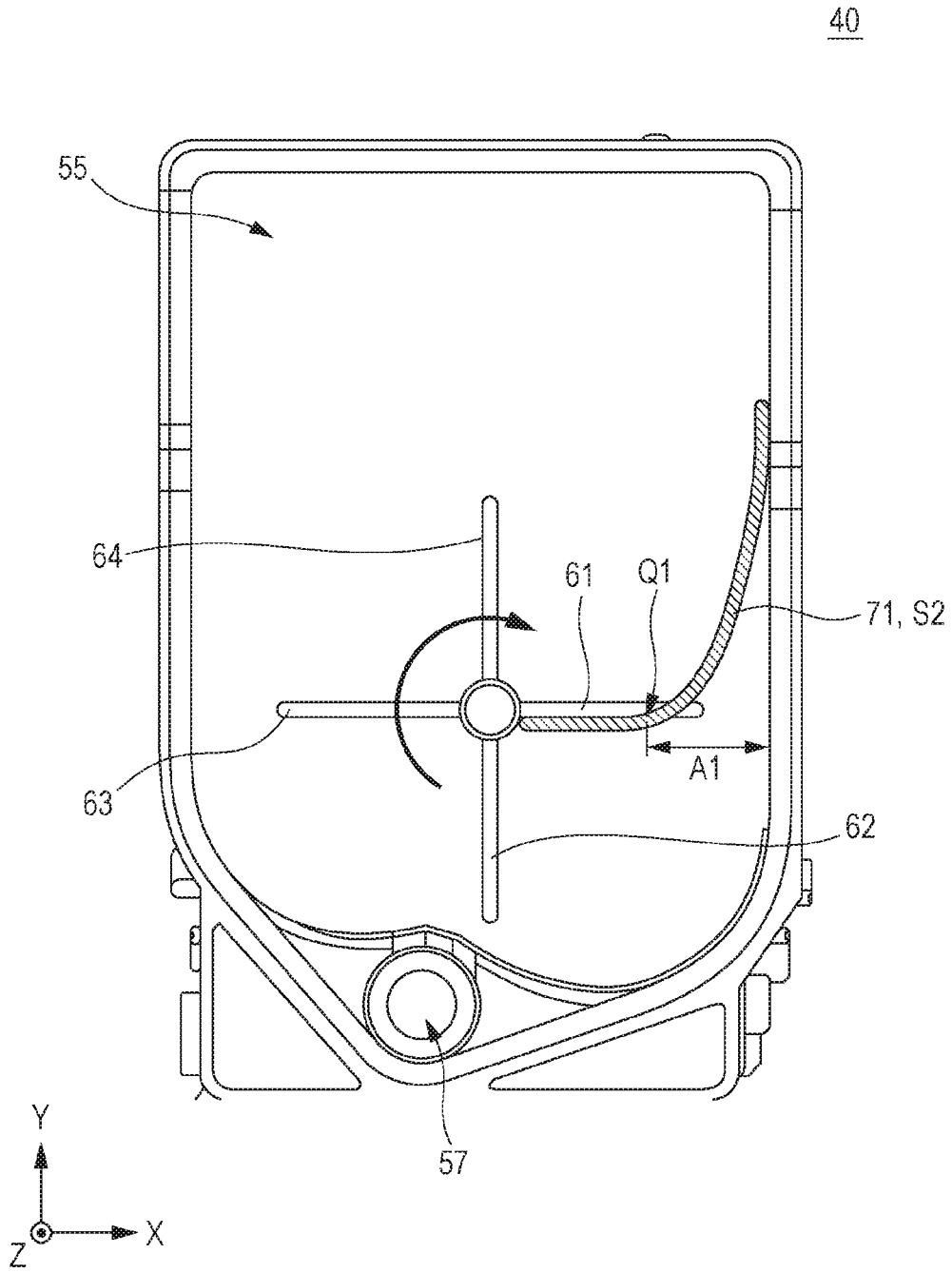
FIG. 8 is a view illustrating a state in which the tip part of the stirring paddle member is oriented rightward (+X side)
Figure 9:
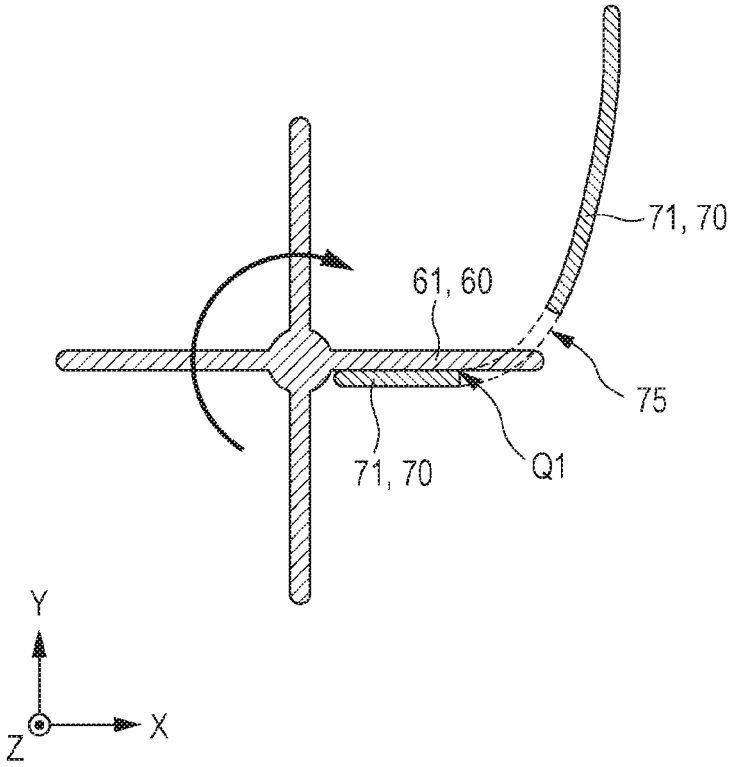
FIG. 9 is a cross-sectional view illustrating a state in which the tip part of the stirring paddle member passes through a through hole of the elastic sheet.

Then, when the elastic sheet 71 is deformed to a state in which the outer peripheral side part of the elastic sheet 71 contacts the inner wall of the toner storage 55 on the more rear side in the rotation direction than the stirring paddle member 61 (see a state S2 in FIG. 8), the tip part of the stirring paddle member 61 passes through the through hole 75 provided at the elastic sheet 71 (see FIGS. 8 and 9). FIG. 8 is a view illustrating a state in which the stirring paddle member 61 (specifically, the tip part of the stirring paddle member 61) is oriented rightward (+X side). Additionally, FIG. 9 is a cross-sectional view illustrating a state in which the tip part of the stirring paddle member 61 passes through the through hole 75 of the elastic sheet 71.

Thus, when the elastic sheet 71 is rotated together with the stirring paddle member 61 in the state in which the outer peripheral side part of the elastic sheet 71 contacts the inner wall of the toner storage 55 on the more rear side in the rotation direction than the stirring paddle member 61, the tip part of the stirring paddle member 61 passes through the through hole 75 (see FIGS. 8 and 9).

After that, the stirring paddle member 61 and the elastic sheet 71 are rotated while keeping the state in which the tip part of the stirring paddle member 61 passes through the through hole 75 (passing-through state).

After that, when the bending degree of the elastic sheet 71 becomes smaller than a predetermined degree in a part of any one of the inner walls of toner storage 55, the tip part of stirring paddle member 61 returns to a non-passing state in the through hole 75 (state of not passing through the through hole 75 (see FIG. 7).

The elastic sheet 71 is rotated along with the above-described operation. Note that the outer peripheral side end part of the elastic sheet 71 is moved contacting many parts of the inner walls of the toner storage 55 while the elastic sheet 71 makes one rotation.

3. Effects of Embodiment

Figure 12:
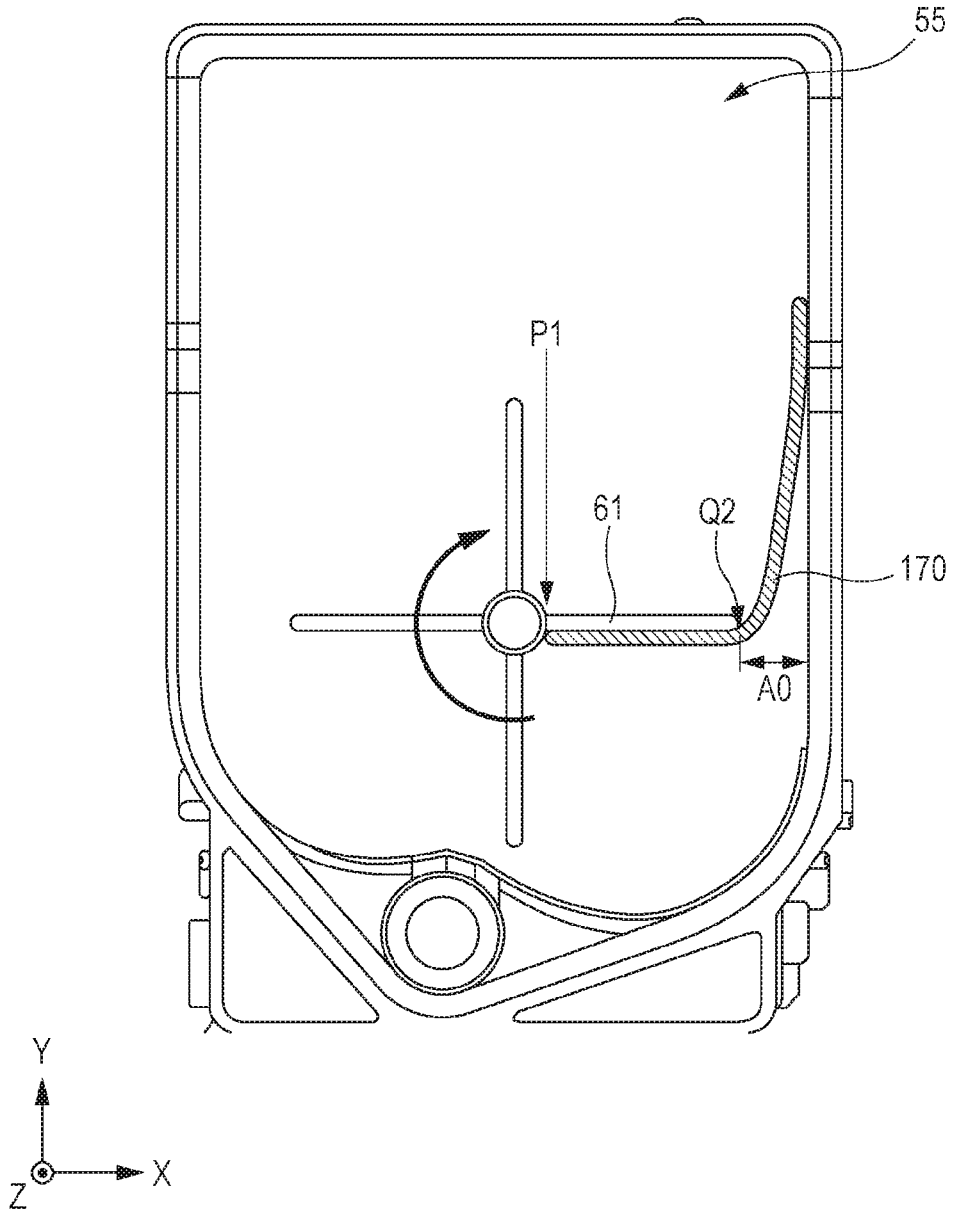
FIG. 12 is a view illustrating a state in which the tip part of the stirring paddle member according to a comparative example is oriented rightward (+X side).

Here, in a case where the elastic sheet is not provided with the through hole 75 (FIG. 6), the following problems may occur. FIG. 12 is a view illustrating a state in which the tip part of the stirring paddle member 61 according to a comparative example is oriented rightward (+X side).

In the case where an elastic sheet 170 is not provided with any through hole 75, when the elastic sheet 170 is rotated together with the stirring paddle member 61, the elastic sheet 170 cannot be deformed in the range corresponding to the region from the root part of the stirring paddle member 61 to a tip Q2 of the stirring paddle member 61 (a fixed part of the elastic sheet 170) (FIG. 12).

Specifically, the elastic sheet 170 is arranged in a manner extending toward the outer peripheral side from the root part P1 (FIG. 12) of the stirring paddle member 61 along the stifling paddle member 61 in the front side part 61*f* in the rotation direction of the stirring paddle member 61 (see FIG. 5). When such an elastic sheet 170 is rotated together with the stirring paddle member 61, the elastic sheet 170 cannot be deformed in the range corresponding to the region from the root part P1 of the stirring paddle member 61 to the tip Q2 of the stirring paddle member 61 because of existence of the stirring paddle member 61 on the rear side in the rotation direction of the elastic sheet 170.

The elastic sheet 170 is deformed in a space A0 (FIG. 12) from the tip Q2 of the stirring paddle member 61 to an inner wall of the toner storage 55. In a case where the space A0 is relatively narrow, the elastic sheet 170 is deformed with a small radius of curvature. In other words, a bending degree of the elastic sheet 170 is increased when the elastic sheet 170 is rotated.

In a case where the elastic sheet 170 is deformed with the small radius of curvature when the elastic sheet 170 is rotated, the elastic sheet 170 is more likely to be plastically deformed. When the elastic sheet 170 is plastically deformed, the elastic force (force directed toward the front side in the rotation direction) in an outer peripheral side part of the elastic sheet 170 is weakened, and the toner adhering to the inner walls of the toner storage 55 is not sufficiently scraped off. Alternatively, in a case where the elastic sheet 170 is bonded to the stirring paddle member 61 with a bonding agent, when the elastic sheet 170 is deformed with the small radius of curvature when the elastic sheet 170 is rotated, the elastic sheet 170 (a bonded part of the elastic sheet 170) may be peeled from the stirring paddle member 61.

On the other hand, in the elastic sheet 71 (70) according to the present embodiment, the through hole 75 is provided at a position corresponding to the tip part of the stirring paddle member 61 (60) (see FIG. 6). Additionally, when the elastic sheet 71 is rotated in the state in which the outer peripheral side part of the elastic sheet 71 contacts, on the more rear side in the rotation direction than the stirring paddle member 61, an inner wall of the toner storage 55, the tip part of the stirring paddle member 61 passes through the through hole 75 (see FIG. 9). As a result, the elastic sheet 71 is deformed not in the space A0 (see FIG. 12) from the tip Q2 of the stirring paddle member 61 to the inner wall of the toner storage 55 but in the relatively large space A1 (FIG. 8) from the part Q1 on the more inner peripheral side than the tip Q2 of the stirring paddle member 61 (inner peripheral side end part of the through hole 75) (see FIG. 9) to the inner wall of the toner storage 55. In other words, the space in which the elastic sheet 71 can be deformed is larger than in the case where the through hole 75 is not provided in the elastic sheet. Therefore, the bending degree of the elastic sheet 71 can be reduced (made gentle) when the elastic sheet 71 is rotated. Furthermore, it is possible to reduce possibility of causing plastic deformation of the elastic sheet 71, and the like.

4. Modified Example

The embodiment of the present invention has been described above, but the present invention is not limited to the content described above.

Modified Example of Entire Length of Elastic Sheet 70

For example, in the above-described embodiment, the entire length L1 (FIG. 6) of the elastic sheet 70 (71) is substantially the same as the length K1 (FIG. 7) that enables contact with the inner wall most distant from the rotation axis (the upper-side inner wall here) out of the inner walls on the four sides including upper, lower, left, and right sides of the toner storage 55 having the substantially rectangular cross-sectional shape in the cross section perpendicular to the axial direction of the rotation axis, but the entire length is not limited thereto.

The entire length L1 of the elastic sheet 70 (71) may also be shorter than the length K1.

Figure 10:
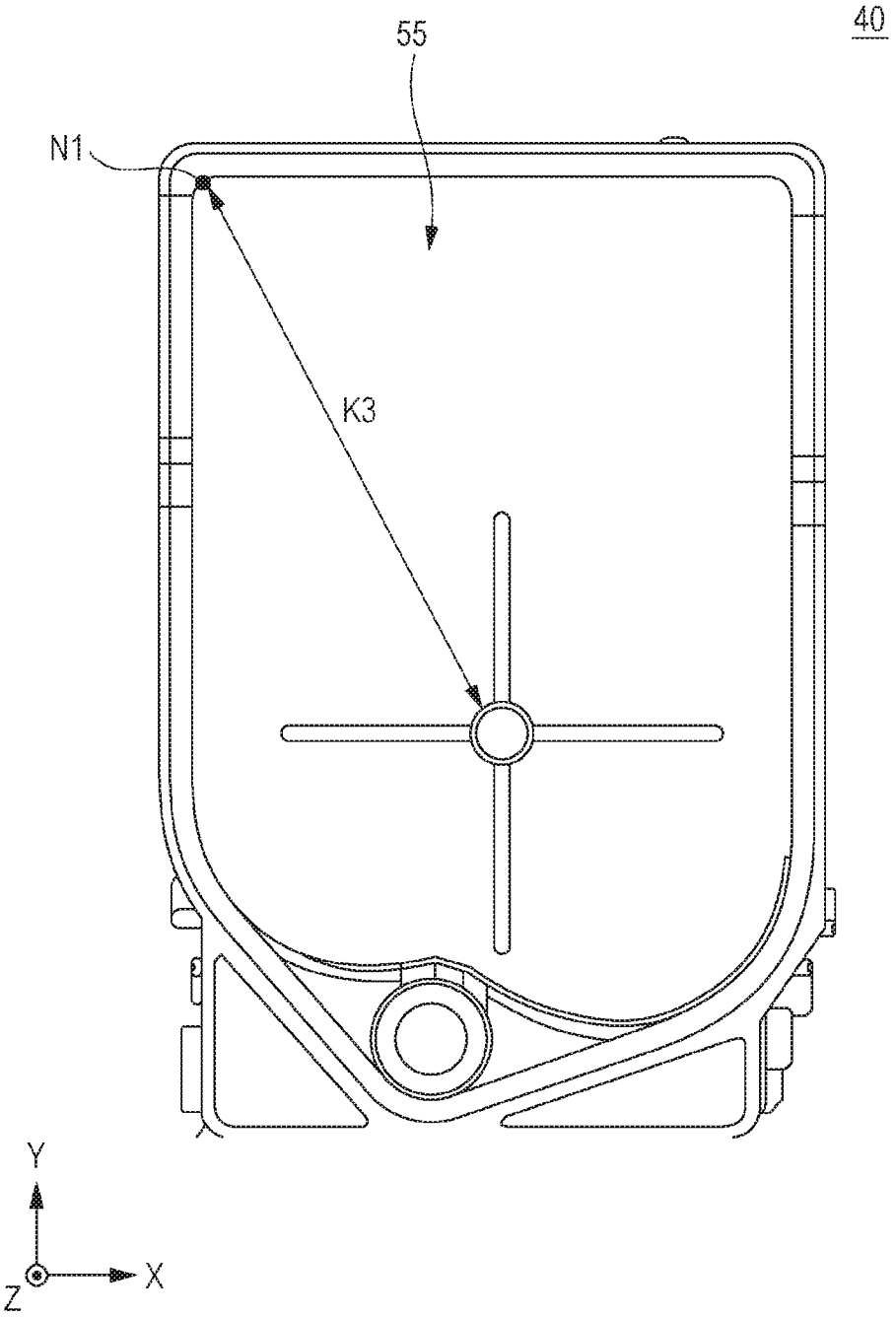
FIG. 10 is a view relating to an entire length of the elastic sheet according to a modified example.

Conversely, the entire length L1 of the elastic sheet 70 (71) may be longer than the length K1. For example, the elastic sheet 71 may have, in the cross section perpendicular to the axial direction of the rotation axis, the length L1 equal to or more than a length that enables the outer peripheral side end part of the elastic sheet 71 to contact an entire perimeter of the inner walls of the toner storage 55 when the elastic sheet 71 is rotated. Stated differently, the elastic sheet 71 has a length long enough to enable the outer peripheral side end part of the elastic sheet 71 to constantly keep contacting the inner walls of the toner storage 55 while the elastic sheet 71 makes one rotation around the rotation axis. Specifically, the entire length L1 of the elastic sheet 71 may be equal to or longer than the length K3 (FIG. 10) that enables the outer peripheral side end part of the elastic sheet 71 to reach (contact) a part (here, an upper left corner N1 of the toner storage 55) located most distant from the rotation axis out of the inner wall of the toner storage 55. With this length, the outer peripheral side part of the elastic sheet 71 can contact the entire perimeter of each of the inner walls of the toner storage 55 by rotation of the elastic sheet 71. Therefore, the toner can be scraped off in a wider range of the inner walls of the toner storage 55.

Modified Example for Number of Elastic Sheets 70

Additionally, in the above-described embodiment and the like, the elastic sheet 70 (71) is provided only at one stirring paddle member 61 out of the plurality of stirring paddle members 61 to 64, but the number of the elastic sheets is not limited to thereto. For example, the elastic sheet 70 may be provided at a stirring paddle member other than the stirring paddle member 61 out of the plurality of stirring paddle members 61 to 64.

Figure 11:
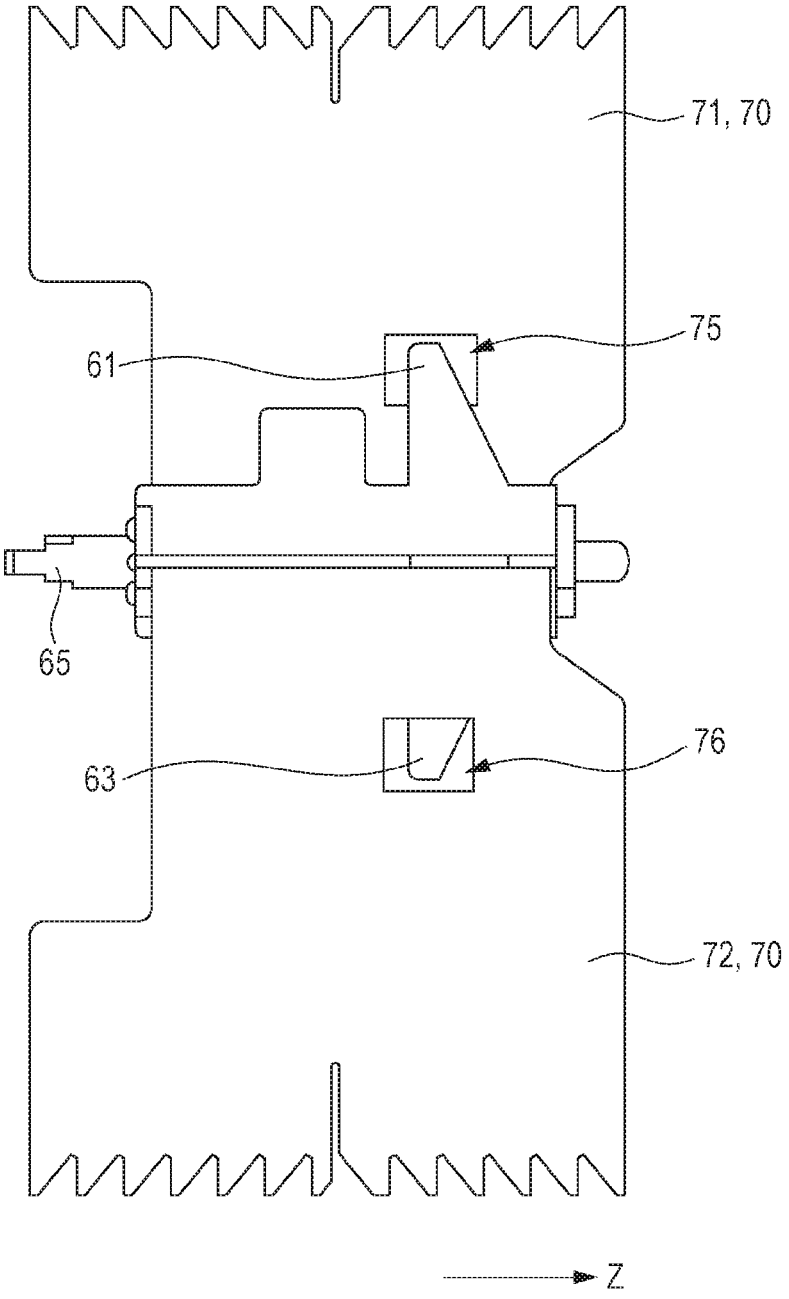
FIG. 11 is a view illustrating the stirring paddle member and elastic sheets according to a modified example.

Specifically, as illustrated in FIG. 11, the elastic sheet 70 (71) may be provided at the stirring paddle member 61 is provided with, and additionally the elastic sheet 70 (another elastic sheet 72) may also be provided at the stirring paddle member 63 (stirring paddle member arranged in a manner shifted by 180 degrees from the stirring paddle member 61 in the rotation direction).

More specifically, one end (inner peripheral side part) of the elastic sheet 72 (elastic sheet extending along the stirring paddle member 63 toward the outer peripheral side) is fixed (bonded) to a front side part in the rotation direction of the stirring paddle member 63 (left side part of the stirring paddle member 63 in the state of FIG. 5). Note that the elastic sheet 72 has a shape same as the elastic sheet 71. Furthermore, when the elastic sheet 72 is rotated together with the stirring paddle member 63 in the state in which the outer peripheral side part of the elastic sheet 72 contacts, on the more rear side in the rotation direction than the stirring paddle member 63 (on the right side of the stirring paddle member 63 in the state of FIG. 5), the inner walls of the toner storage 55, the tip part of the stirring paddle member 63 passes through the through hole 76 provided at the elastic sheet 72 (FIG. 11).

Thus, in addition to the stirring paddle member 61, the elastic sheet 70 (72) may also be provided at the stirring paddle member 63. Note that the elastic sheet 70 may also be provided at the stirring paddle member 62 and/or the stirring paddle member 64 in addition to the stirring paddle members 61 and 63.

With this structure, the plurality of elastic sheets 70 is used to scrape off the toner adhering to the inner walls of the toner storage 55, and therefore, the toner adhering to the inner walls of the toner storage 55 can be surely scraped off.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner stirring device comprising:

a toner storage that stores toner;

a stirring member that is rotated around a rotation axis to stir the toner inside the toner storage and extends to a radially outer peripheral side; and an elastic sheet that has one end fixed to a front side part in a rotation direction of the stirring member and extends to an outer peripheral side along the stirring member, wherein the elastic sheet includes a through hole at a position corresponding to a tip part of the stirring member, and the tip part of the stirring member passes through the through hole when the elastic sheet is rotated together with the stirring member in a state in which an outer peripheral side part of the elastic sheet contacts, on a more rear side in the rotation direction than the stirring member, an inner wall of the toner storage.

2. The toner stirring device according to claim 1, wherein the stirring member is a first stirring member, the elastic sheet is a first elastic sheet, the toner stirring device further includes:

a second stirring member that is rotated around the rotation axis to stir the toner inside the toner storage, extends to a radially outer peripheral side, and is arranged in a manner shifted from the first stirring member by a predetermined angle in the rotation direction; and a second elastic sheet that has one end fixed to a part on a front side part in the rotation direction of the second stirring member and extends to an outer peripheral side along the second stirring member, the second elastic sheet includes a through hole at a position corresponding to a tip part of the second stirring member, and the tip part of the second stirring member passes through the through hole of the second elastic sheet when the second elastic sheet is rotated together with the second stirring member in a state in which an outer peripheral side part of the second elastic sheet contacts, on the more rear side in the rotation direction than the second stirring member, the inner wall of the toner storage.

3. The toner stirring device according to claim 1, wherein the elastic sheet has, in a cross section perpendicular to the axial direction of the rotation axis, a length equal to or longer than a length that enables an outer peripheral side end part of the elastic sheet to contact an entire perimeter of the inner wall of the toner storage at the time of rotation of the elastic sheet.

4. An image forming apparatus comprising the toner stirring device according to claim 1.

* * * * *